US005459557A

United States Patent [19]

Hasegawa et al.

[11] Patent Number: 5,459,557

[45] Date of Patent: Oct. 17, 1995

[54] IMAGE FORMING APPARATUS

[75] Inventors: Yuji Hasegawa, Tokyo; Yukio Takemura, Kawasaki; Yuichi Takashiro, Yokohama, all of Japan

[73] Assignee: Canon Kabushiki Kaisha, Tokyo, Japan

[21] Appl. No.: 78,048

[22] Filed: Jun. 18, 1993

[30] Foreign Application Priority Data

Jun. 30, 1992 [JP] Japan ..... 4-173241
Jun. 30, 1992 [JP] Japan ..... 4-173242

[51] Int. Cl.[6] ..... G03G 15/043

[52] U.S. Cl. ..... 355/218; 355/71; 355/229; 359/738; 362/279

[58] Field of Search ..... 355/218, 229, 355/71; 359/738, 739; 362/321, 279

[56] References Cited

U.S. PATENT DOCUMENTS

| | | | |
|---|---|---|---|
| 3,778,148 | 12/1973 | Fujitsuka et al. | 355/218 |
| 4,129,378 | 12/1978 | Rattin et al. | 355/218 |
| 4,133,609 | 1/1979 | Arai | 355/71 X |
| 4,256,400 | 3/1981 | Komori et al. | 355/71 X |
| 4,364,658 | 12/1982 | Seto et al. | 355/233 |
| 4,429,353 | 1/1984 | Tokuhara et al. | 362/232 |
| 4,477,179 | 10/1984 | Inuzuka et al. | 355/218 X |
| 4,552,447 | 11/1985 | Sagara et al. . | |
| 4,553,232 | 8/1985 | Fujimura et al. | 355/229 X |
| 4,708,464 | 11/1987 | Otsuki et al. | 355/71 X |
| 4,728,982 | 3/1988 | Takemura | 355/218 |
| 4,876,570 | 10/1989 | Iwaya | 355/218 |
| 4,905,040 | 2/1990 | Nagai et al. | 355/43 |
| 5,068,687 | 11/1991 | Kamimura et al. | 355/218 |

FOREIGN PATENT DOCUMENTS

| | | |
|---|---|---|
| 48-71240 | 9/1973 | Japan . |
| 57-201267 | 12/1982 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus such as electrophotographic copying machine is disclosed. The apparatus is provided with a common light source of preexposure and blank exposure, and shutters for blank exposure movable in a perpendicular direction to a moving direction of photosensitive body in order to change an exposure width.

28 Claims, 7 Drawing Sheets

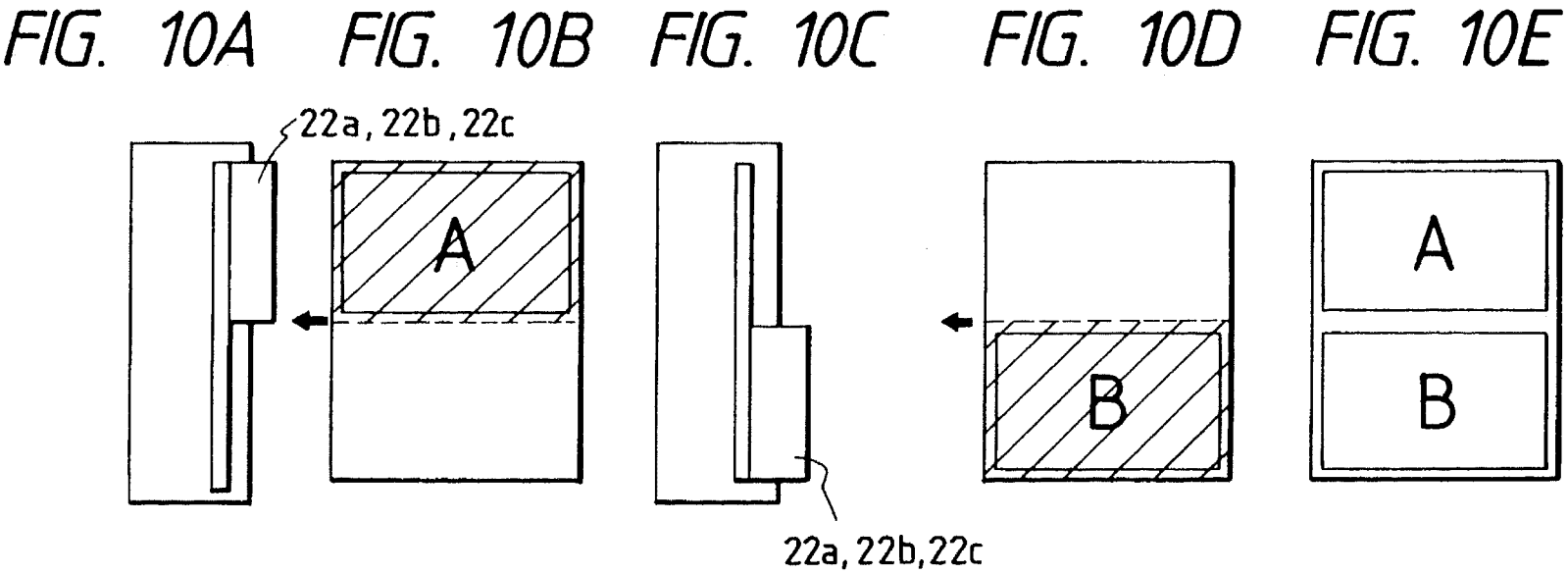
FIG. 10A
FIG. 10B
FIG. 10C
FIG. 10D
FIG. 10E
22a, 22b, 22c
A
B
22a, 22b, 22c
A
B
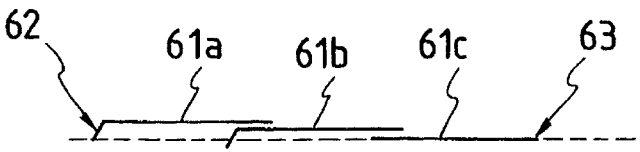
FIG. 12
63
61c
61b
61a
62

IMAGE FORMING APPARATUS

BACKGROUND OF THE INVENTION

1. Field of the Invention

The present invention relates to an image forming apparatus such as an electrophotographic copying apparatus and, more particularly, to exposing means for exposing a photosensitive body.

2. Related Background Art

Conventionally, in an apparatus of the above sort, as disclosed in Japanese Laid-Open Patent Application Nos. 48-71240 and 57-201267, light rays generated by a single light source are split into two light components by a reflecting plate. One component is radiated onto the surface of a photosensitive body as preexposure light (exposure light for erasing the residual charge on the entire surface of the photosensitive body before the photosensitive body is charged), and the other as blank exposure light (exposure light for erasing only the residual charge except that on an image region after the photosensitive body is charged).

In Japanese Laid-Open Patent Application No. 48-71240, only unnecessary image regions at the leading and the trailing ends of an image formed on the surface of a photosensitive body are erased by blank exposure light and a shutter is provided for selectively shielding the blank exposure light. In Japanese Laid-Open Patent Application No. 57-201267, a shutter having the above function is divided into a plurality of portions in the axial direction of a photosensitive body, and each divided portion of the shutter can selectively shield exposure light. Therefore, images that are enlarged or reduced at various magnifications can be processed.

The apparatus disclosed in Japanese Laid-Open Patent Application No. 48-71240, however, cannot process enlarged or reduced images because the apparatus has only the function of erasing unnecessary image regions at the leading and the trailing ends of an image. In addition, in order for the apparatus disclosed in Japanese Laid-Open Patent Application No. 57-201267 to meet various magnifications, it is necessary to arrange shutters in a number corresponding to the number of magnifications, resulting in a complicated and bulky apparatus.

SUMMARY OF THE INVENTION

It is an object of the present invention to provide an apparatus having a common light source for preexposure and blank exposure, in which light-shielding means for blank exposure is movable in a direction perpendicular to a moving direction of a photosensitive body.

It is another object of the present invention to provide an apparatus for driving first and second light-shielding members for blank exposure by using discrete driving means.

It is still another object of the present invention to provide an apparatus in which three light-shielding members of blank exposing means are movable in a direction perpendicular to the moving direction of a photosensitive body.

Other objects and advantages of the invention will become apparent from the following detailed description taken in conjunction with the appended claims.

BRIEF DESCRIPTION OF THE DRAWINGS

FIGS. 10A to 10E are views showing the relationship between the slide shutters and the images formed;

FIG. 12 is a view showing slide shutters according to another embodiment of the present invention.

DETAILED DESCRIPTION OF THE PREFERRED EMBODIMENTS

The embodiments of the present invention will be described in detail below with reference to the accompanying drawings.

Figure 1:
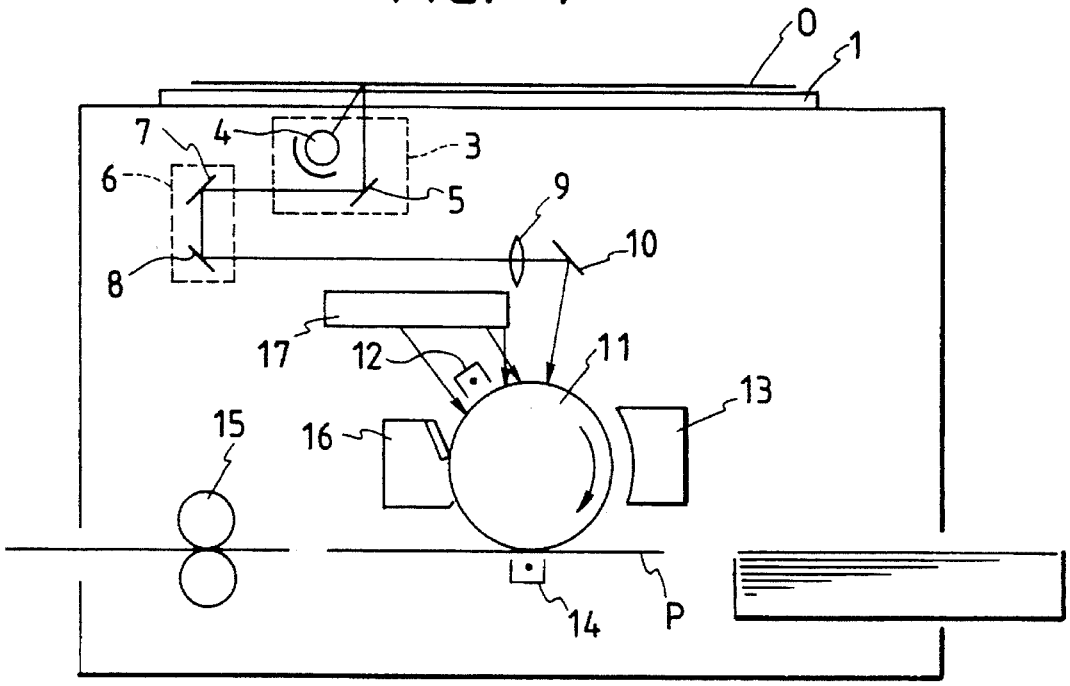
FIG. 1 is a schematic sectional view showing an image forming apparatus according to one embodiment of the present invention.

FIG. 1 is a schematic sectional view showing an image forming apparatus according to the present invention. Referring to FIG. 1, an original 0 placed on an original table 1 is illuminated by a light source 4 incorporated in first scanning means 3, and the image light from the illuminated original 0 is reflected by a reflecting mirror 5 arranged in the first scanning means 3. The image light from the reflecting mirror 5 is reflected to make a U-turn by reflecting mirrors 7 and 8 of second scanning means 6. This image light exposes, via a lens 9 and a reflecting mirror 10, a photosensitive drum 11 charged by a charger 12, forming a latent image on the photosensitive drum 11. The first scanning means 3 moves across the full width of the original table 1 to scan it, and the second scanning means 6 moves to perform scan at a rate ½ that of the first scanning means 3 in association with the movement of the first scanning means 3.

The latent image formed on the photosensitive drum 11 is visualized by a developing unit 13 by using toner, and the resulting toner image is transferred to a recording medium P by a transfer unit 14. The toner on the recording medium P is fixed by a fixing unit 15, and the resulting recording medium P is delivered outside the apparatus. The residual toner on the photosensitive drum 11 after the transfer is removed by a cleaning device 16. Exposing means 17 has a single light source and performs preexposure and blank exposure by using light from this light source. The preexposure is to uniformly expose the photosensitive drum 11 at a position upstream of the charger 12 in the rotating direction of the photosensitive drum 11. The blank exposure is to expose non-image portions at the end portions (the end portions in the rotating direction of the photosensitive body and the end portions in a direction perpendicular to the rotating direction of the photosensitive body) of an image formed on the photosensitive drum 11 at a position downstream of the charger 12 in the rotating direction of the photosensitive drum 11. The exposing means 17 will be described in detail below.

Figure 2:
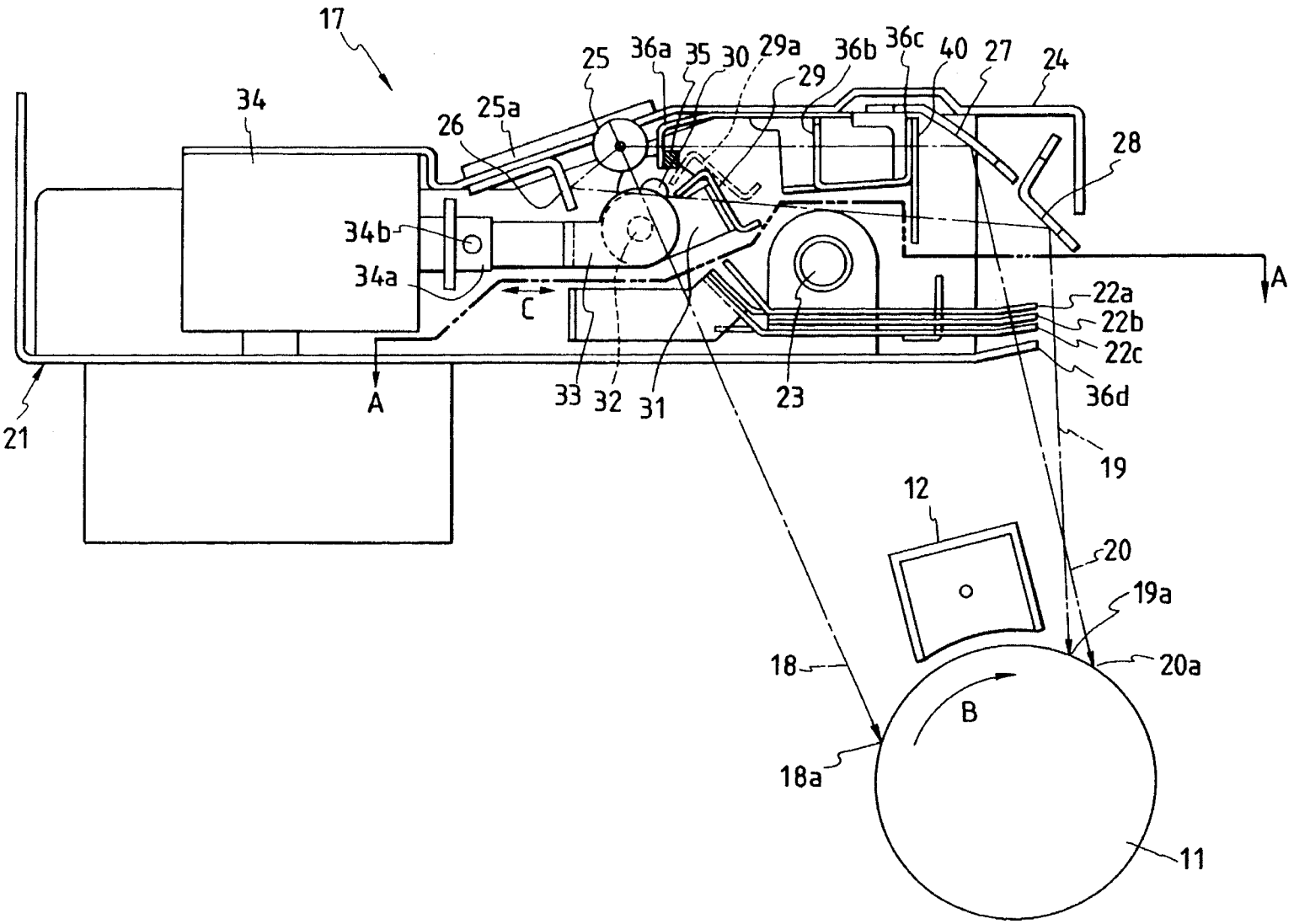
FIG. 2 is a view showing exposing means of the embodiment shown in FIG. 1.

FIG. 2 is a sectional view showing the main part of the exposing means of this embodiment, in which the photosensitive drum 11 rotates in a direction indicated by an arrow B, and the charger 12 for uniformly charging the photosensitive drum 11 is connected to a high-voltage power supply (not shown). Preexposure light is radiated onto an irradiation position 18*a* on the upstream side of the charger 12 through a preexposure optical path 18, erasing the residual charge before charging is performed by the charger 12.

Leading-and-trailing-end blank exposure light from the first blank exposing means is radiated onto an irradiation position 19*a* on the downstream side of the charger 12 through a leading-and-trailing-end blank exposure optical path 19, forming image end portions perpendicular to the rotating direction of the photosensitive body, that is, non-image portions at the end portions of an image in the rotating direction of the photosensitive body.

Width blank exposure light from the second blank exposing means is radiated onto an irradiation position 20*a* on the downstream side of the charger 12 through a width blank exposure optical path 20, forming image end portions parallel to the rotating direction of the photosensitive body, that is, non-image portions at the end portions of an image in a direction perpendicular to the rotating direction of the photosensitive body.

The width blank exposure light is constantly radiated during image formation, whereas the leading-and-trailing-end blank exposure light radiates only the leading and the trailing ends of an image through a shutter (to be described later). The irradiation ranges of the width blank exposure light and the leading-and-trailing-end blank exposure light overlap each other in the circumferential direction of the photosensitive drum.

The blank exposing means 17 is a unit including a lower frame 21 and a first slide shutter (front) 22*a*, a third slide shutter (middle) 22*b*, and a second slide shutter (back) 22*c* which are light-shielding members for controlling the passing ranges of the width blank exposure light in a direction perpendicular to the rotating direction of the photosensitive body. The first, third, and second slide shutters 22*a*, 22*b*, and 22*c* are arranged at a position closest to the photosensitive drum 11 in the optical path of the width blank exposure light and slide on a rail 23 supported by the lower frame 21. The third slide shutter 22*b* is movable along the longitudinal direction of the rail 23 with its portions engaged with the first and second slide shutters 22*a* and 22*c*. Therefore, the third slide shutter 22*b* constantly exists between the first and second slide shutters 22*a* and 22*c*, and so the width blank exposure optical path 20 can pass only outside the first and second slide shutters 22*a* and 22*c*. In addition, when the three slide shutters completely overlap one another, the length of a non-exposure region on the surface of the photosensitive body in the direction perpendicular to the rotating direction of the photosensitive body is smaller than the width of an image recording sheet with a minimum size usable in the image forming apparatus. Also, when the first and second slide shutters 22*a* and 22*c* are in home positions (to be described later), the length of the non-exposure region on the photosensitive body surface in the direction perpendicular to the rotating direction of the photosensitive body is larger than the width of an image recording sheet with a maximum size usable in the image forming apparatus.

The unit constituting the blank exposing means also includes an upper frame 24 and a lamp 25 serving as a common light source for the preexposure, the width blank exposure and the leading-and-trailing-end blank exposure (the lamp 25 is formed by arranging a plurality of light-emitting sources in the axial direction of the photosensitive drum 11). A PCB (Printed Circuit Board) 25*a* supported by the upper frame 24 supports the lamp 25.

A reflecting shade 27 guides the light from the lamp 25 to the width blank exposure irradiation position 20*a*. The reflecting shade 27 has a cylindrical quadric-surface section so as to focus light into a predetermined width.

Reflecting shades 26 and 28 guide the light from the lamp 25 to the leading-and-trailing-end blank exposure irradiation position 19*a*. Each of the reflecting shades 26 and 28 has a cylindrical quadric-surface section so as to focus light into a predetermined width.

Although the reflecting shades 27 and 28 may also be constituted by flat members, the quadric-surface shape described above is desirable because a flat shade narrows the tolerance of positional deviation of the lamp 25, leading to variations in light quantity.

The reflecting shades 26, 27, and 28 are made of an aluminum plate which is light in weight and can be machined easily.

Both end portions of each of the reflecting shades 26, 27, and 28 in their longitudinal directions are supported by a support plate (not shown), so the reflecting shades 26, 27, and 28 are integrated with the upper frame 24. A shutter 29 selectively controls the passing of the leading-and-trailing-end blank exposure optical path 19. The shutter 29 is arranged very close to the lamp 25 as a light source with its both end portions in the longitudinal direction pivotally supported at a pivot center 30. In this embodiment, as described above, the common light source is used for the preexposure, the leading-and-trailing-end blank exposure, and the width blank exposure performed by the slide shutters, and this simplifies and miniaturizes the overall apparatus.

A tongue-like member 31 is formed integrally with the shutter 29 at the center in the longitudinal direction of the shutter 29. A link 33 engages with the tongue-like member 31 via a caulking shaft 32. The link 33 also engages with a caulking shaft 34*b* of an iron core 34*a* of a solenoid 34 which is supported by the upper frame 24. Upon driving of the solenoid 34, the link 34 moves in a direction indicated by an arrow C, thereby opening or closing the shutter 29. A shutter damper 35 prevents the vibration noise of the shutter 29 itself when the shutter 29 is driven or the collision of the shutter 29 against other parts when the shutter 29 is raised above an open position indicated by a broken line 29*a*. Note that this member is attached between the opening portions of a slit plate 36*a* (to be described later) and hence does not interfere with exposure.

Figure 3:
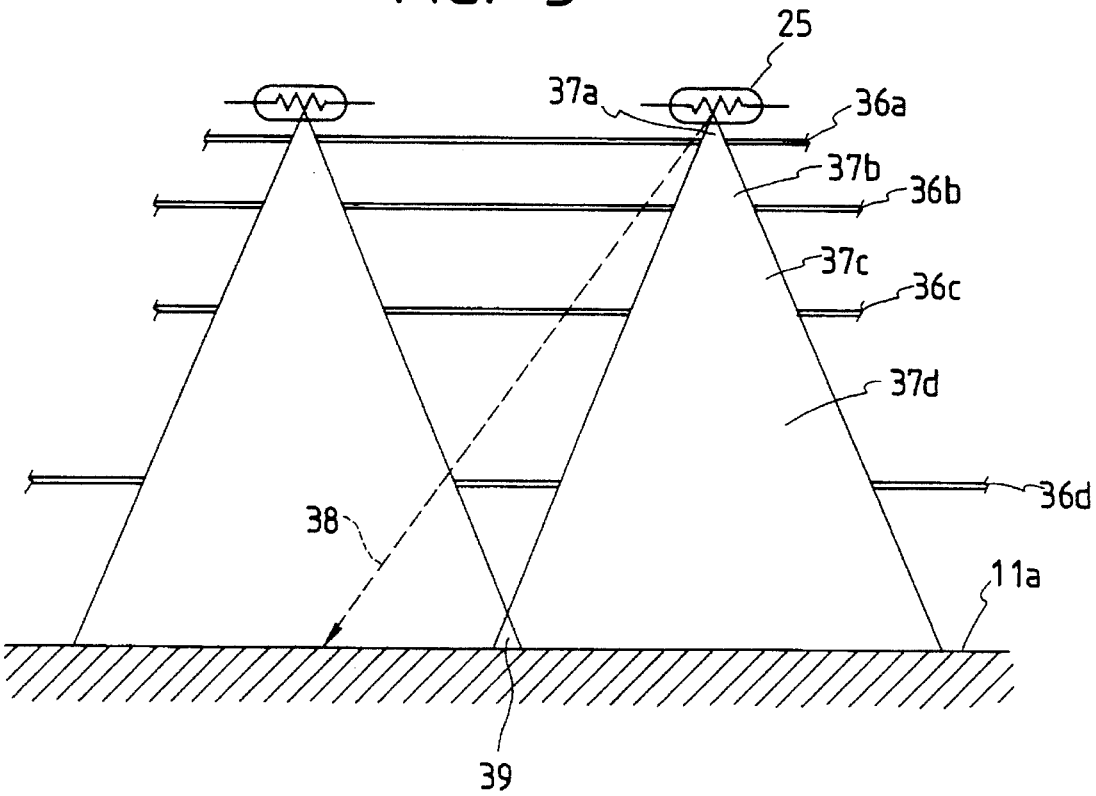
FIG. 3 is a view showing slits of the exposing means shown in FIG. 2.

FIG. 3 shows the schematic arrangement of slit plates 36*a*, 36*b*, 36*c*, and 36*d* in their longitudinal directions.

Referring to FIG. 3, a surface position 11*a* of the photosensitive drum and an opening 37*a* of the slit plate 36*a* are illustrated. The lamp 25 can be regarded as a substantially point light source because of the presence of the opening 37*a*. Openings 37*b*, 37*c*, and 37*d* of the slit plates 36*b*, 36*c*, and 36*d*, respectively, widen toward the surface of the photosensitive drum. This makes it possible to prevent stray light 38 and increase the positional precision of the irradiation positions (particularly a portion 39 where the irradiation ranges of the adjacent lamps overlap each other) on the drum. An ultraviolet cut filter 40 is provided on the slit plate 36*c* at a position at which the filter 40 can cover a region through which both the leading-and-trailing-end blank exposure light and the width blank exposure light pass, and at which these two light components are incident nearly perpendicularly with respect to the filter surface. For this reason, the incident light rays are reflected very little by the filter surface, and the filter area can be decreased because the incident area is minimized.

Figure 4:
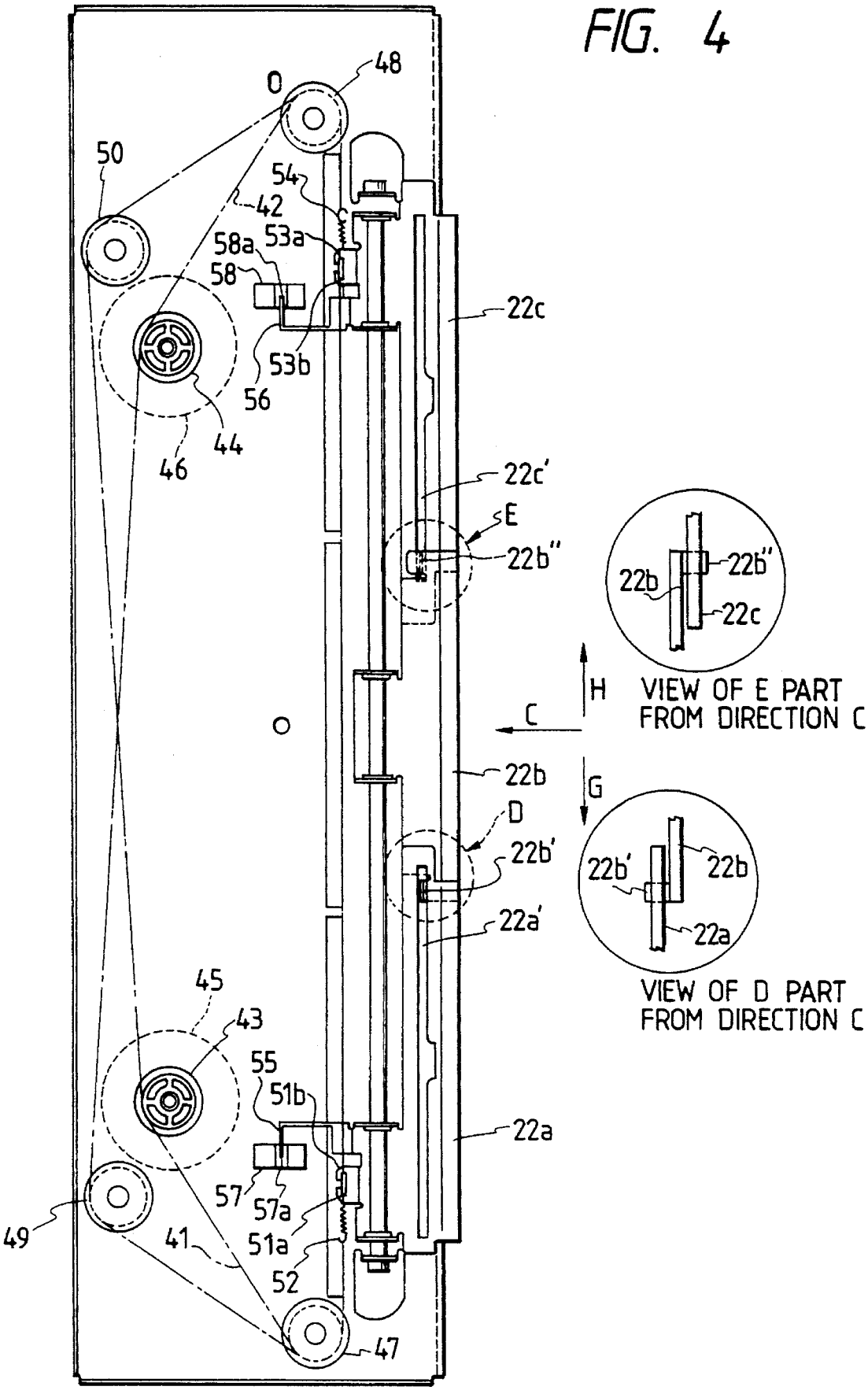
FIG. 4 is a view showing slide shutters of the exposing means shown in FIG. 2.

FIG. 4 is a top view (sectional view taken along a line A—A in FIG. 2) showing this embodiment. Referring to FIG. 4, wires 41 and 42 are used to move the first slide shutter (front) 22*a* and the second slide shutter (back) 22*c*, respectively, and drive pulleys 43 and 44 drive the wires 41 and 42, respectively. The control of forward and backward rotations and the positioning of the drive pulleys 43 and 44 are performed by pulse motors 45 and 46, respectively. Idler pulleys 47, 48, 49, and 50, each of which is a pair of two pulleys (arranged in a direction perpendicular to the sheet of drawing), support the wires 41 and 42. The idler pulleys 47 to 50 are rotatably supported independently of one another by shafts fixed to the lower frame 21. One end of the wire 41 engages with a tension spring 52 which engages with a hook 51*a* of the first slide shutter 22*a*, and the other end of the wire 41 engages with a hook 51*b* of the first slide shutter 22*a*, such that the wire 41 is looped between the upper pulleys (upper idler pulleys) in the order of the idler pulley 47, the drive pulley 43, the idler pulley 50, and the idler pulley 48, thereby forming a first loop-like wire-pulley driving system. On the other hand, one end of the wire 42 engages with a tension spring 54 which engages with a hook 53*a* of the second slide shutter 22*c*, and the other end of the wire 42 engages with a hook 53*b* of the second slide shutter 22*c*, such that the wire 42 is looped between the lower pulleys (lower idler pulleys) in the order of the idler pulley 48, the drive pulley 44, the idler pulley 49, and the idler pulley 47, thereby forming a second loop-like wire-pulley driving system. These two wire-pulley driving systems, therefore, can independently drive the first and second slide shutters 22*a* and 22*c* without interfering with each other. Flags 55 and 56 are also formed on the first and second slide shutters 22*a* and 22*c*, respectively. The absolute positions of the first and second slide shutters 22*a* and 22*c* can be detected by passing of the ends of these flags through front and back sensor points 57*a* and 58*a* of front and back photointerrupters 57 and 58, respectively, fixed to the lower frame 21. This allows the first and second slide shutters 22*a* and 22*c* to move to or stop at given positions, and so the range of an exposure area formed by the lamp 25 on the photosensitive drum 11 in the direction perpendicular to the rotating direction of the photosensitive body can be freely controlled.

In this embodiment as described above, the first and second slide shutters 22*a* and 22*c* provided at positions corresponding to the end portions in the axial direction of the photosensitive body can move independently of each other. Therefore, the widths of non-image portions can be freely set independently of each other at the two end portions in the axial direction of the photosensitive body. This enables the apparatus to perform not only enlargement or reduction at a given magnification but various image edit operations. For example, only a half side of the photosensitive body can be used as an image portion.

In addition, as shown in FIG. 4 described above, the two end portions of the third slide shutter 22*b* arranged between the first and second slide shutters 22*a* and 22*c* engage with the first and second slide shutters 22*a* and 22*c*. More specifically, a projection 22*b*' is formed on one end portion of the third slide shutter 22*b* and fitted in an opening portion 22*a*' formed in the first slide shutter 22*a*. The opening portion 22*a*' is elongated in the direction of movement of the slide shutter, and the projection 22*b*' is movable in the opening portion 22*a*'. Therefore, the first and third slide shutters 22*a* and 22*b* can overlap each other.

A projection 22*b*" is also formed on the other end portion of the third slide shutter 22*b* and fitted in an opening portion 22*c*' formed in the second slide shutter 22*c*. The opening portion 22*c*' of the second slide shutter 22*c* is elongated in the direction of movement of the slide shutter, and the projection 22*b*" is movable in the opening portion 22*c*'. This enables the second and third slide shutters 22*c* and 22*b* to overlap each other.

The slide shutter 22*b* has no dedicated driving means and is therefore moved when the projection 22*b*' and/or the projection 22*b*" is pushed or pulled by the end portion of the opening portion in the first slide shutter 22*a* and/or the second slide shutter 22*c*.

Figure 5:
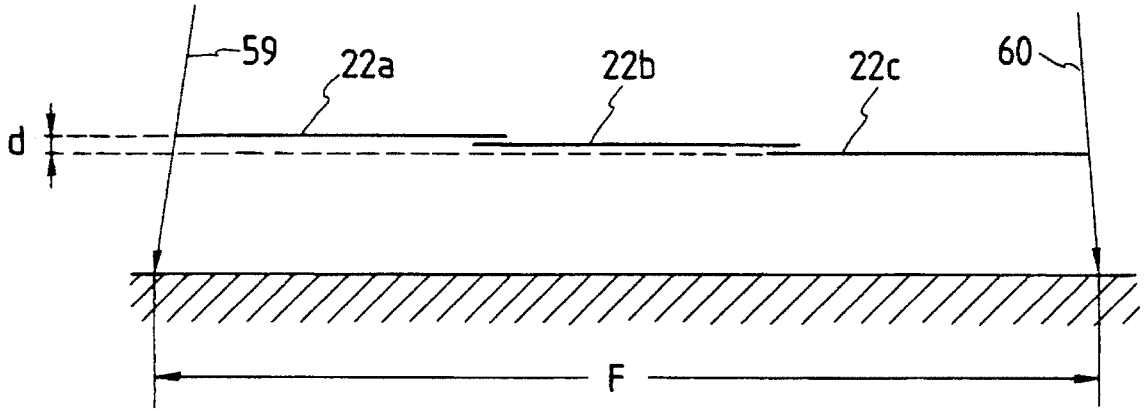
FIG. 5 is a view showing the slide shutters shown in FIG. 4 from a direction C.

FIG. 5 is a schematic view showing the slide shutters 22*a*, 22*b*, and 22*c* shown in FIG. 4 from the direction of the arrow C. Referring to FIG. 5, width blank exposure light components 59 and 60 are radiated on the photosensitive drum 11 while regulated by the first and second slide shutters 22*a* and 22*c*. A length F of a non-exposure area formed by the slide shutters 22*a*, 22*b*, and 22*c* is also illustrated.

Since the third slide shutter 22*b* engages with the first and second slide shutters 22*a* and 22*c*, no spaces are formed between the first and third slide shutters 22*a* and 22*b* and between the third and second slide shutters 22*b* and 22*c*. This prevents latent images formed on the photosensitive body from being erased by a leakage of blank exposure light.

Figure 6:
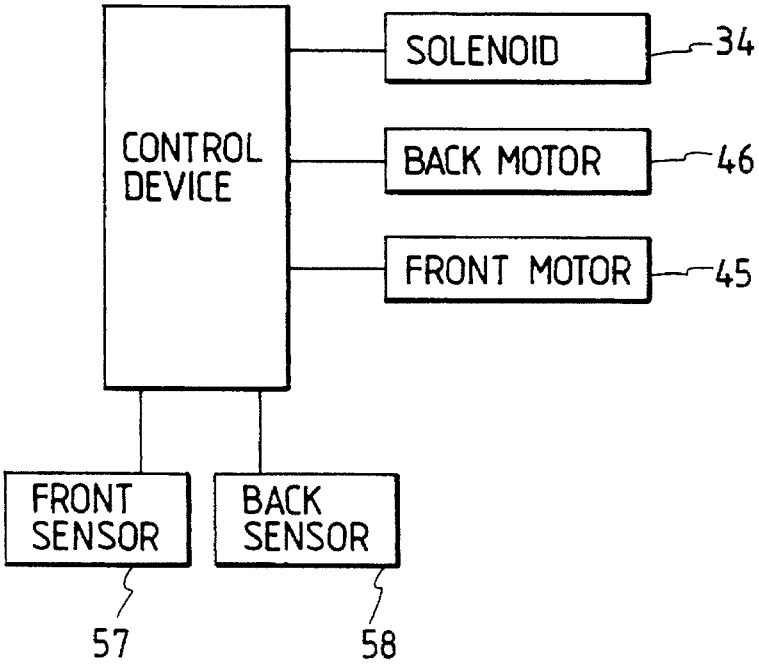
FIG. 6 is a control block diagram related to the slide shutters.

FIG. 6 is a block diagram showing a control device and its peripheral blocks according to this embodiment.

The position control for the first and second slide shutters 22*a* and 22*c* is as follows. That is, when the power supply of the image forming apparatus is switched on, in order to detect the respective reference positions of the two slide shutters, the first and second slide shutters 22*a* and 22*c* start to move (to perform home position search) in directions indicated by arrows G and H, respectively (see FIG. 4). Subsequently, when the flags 55 and 56 pass the front and back sensor points 57*a* and 58*a*, the control device starts counting drive pulses to be applied to the pulse motors 45 and 46 and at the same time stops the pulse motors 45 and 46. The control device moves the first and second slide shutters 22*a* and 22*c* in the directions indicated by the arrows H and G, respectively, in an amount corresponding to the number of drive pulses counted before the pulse motors 45 and 46 are stopped. As a result, the ends of the flags 55 and 56 stop at the positions of the front and back sensor points 57*a* and 58*a*, thereby determining the home positions. By using these home positions as reference positions, the driving and positioning of the shutters are performed in accordance with the number of drive pulses to be applied to the pulse motors 45 and 46.

Figure 7:
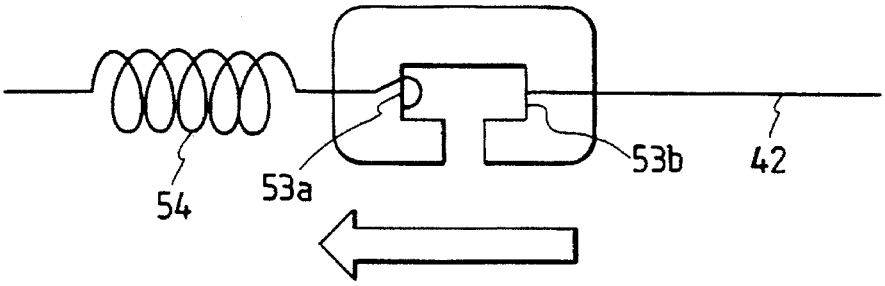
FIG. 7 is a view showing a wire attachment portion for driving the slide shutters.
Figures 8A, 8B, 8C, 8D:
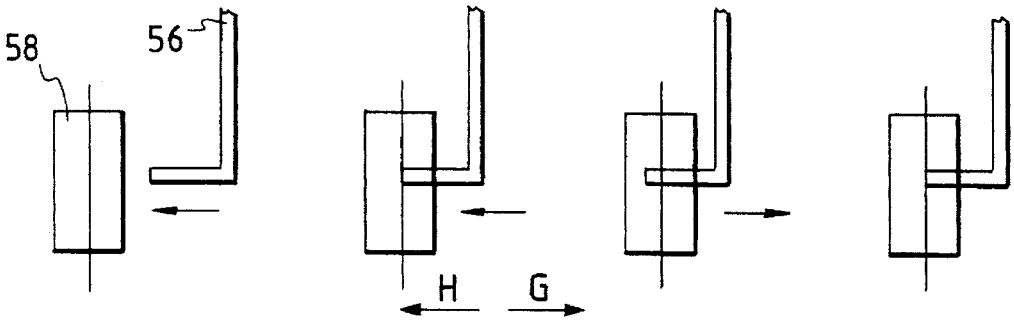
FIGS. 8A to 8D are views showing the relationship between the flag of the slide shutter and the sensor.

That is, as shown in FIG. 7, the wire 42 is applied with a tension by the spring 54 (note that this description applies similarly to the wire 41). Therefore, when the wire 42 is moved in a direction indicated by an arrow in FIG. 7, the slide shutter 22*c* is pulled by the spring 54, and the consequent deformation of the spring makes accurate positioning difficult. In this embodiment, as shown in FIGS. 8A to 8D, the home position is determined not at the instant the sensor flag 56 (FIG. 8A) turns off the sensor 58 (FIG. 8B) but at the instant the sensor flag 56 is moved by an overstroke and returned (FIG. 8C) to turn on the sensor 58 (FIG. 8D). This allows accurate positioning free from an influence of the displacement of the spring.

If the flag 56 is within the range of the sensor 58 when the power supply of the image forming apparatus is switched on, the above operation is performed after the second slide shutter is moved by a predetermined amount in the direction indicated by the arrow G.

In addition, when the positioning is to be performed by moving the second slide shutter 22*c* in the direction indicated by the arrow H, the second slide shutter 22*c* is first returned to the home position and then moved in the direction indicated by the arrow G and stopped.

Although the above description of the operation is made for the second slide shutter 22*c*, the operation is exactly the same with the first slide shutter 22*a*; that is, the first slide shutter 22*a* is controlled symmetrically with the second slide shutter 22*c*.

Figure 9A:
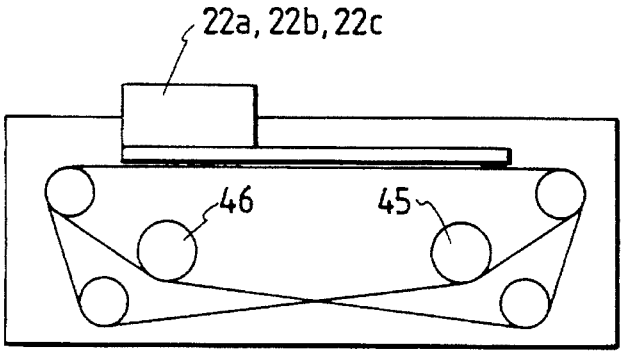
FIGS. 9A and 9B are views showing the way the slide shutters move.
Figure 9B:
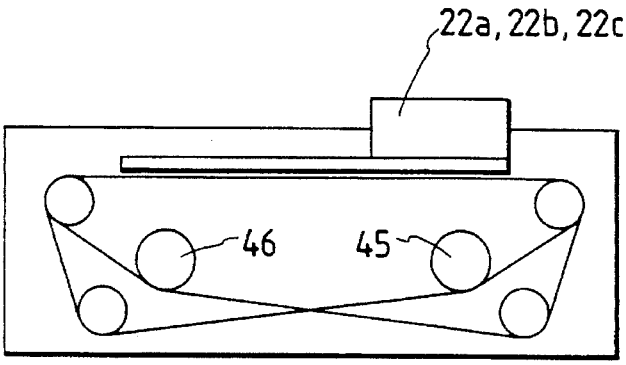

An operation performed when a plurality of slide shutters are to be moved simultaneously (FIGS. 9A and 9B), such as in reduced layout copying, will be described below. For example, when the slide shutters are to be moved from the state shown in FIG. 9A to the state shown in FIG. 9B, the first and second slide shutters 22*a* and 22*c* are not moved simultaneously; the first slide shutter 22*a* is first moved to a predetermined position, and then the second shutter 22*c* is moved to a predetermined position. If the control is performed in the reverse order, i.e., if the second slide shutter 22*c* is moved first by the stepping motor 46, the first shutter 22*a* is also moved via the third slide shutter 22*b* because the third slide shutter 22*b* engages with both the first and second slide shutters 22*a* and 22*c*. This rotates the stepping motor 45 in an inoperative state. However, the above control can move a plurality of slide shutters without operating the two stepping motors at the same time. It is, of course, possible to move a plurality of shutters simultaneously by operating the two stepping motors at the same time. In this case, control is performed such that each of the first and second slide shutters 22*a* and 22*c* does not collide against the third slide shutter 22*b*.

The use of the blank exposing means of the embodiment with the above arrangement allows reduced layout copying as described below.

FIGS. 10A to 10D are views showing the positions (FIGS. 10A and 10C) of the slide shutters and the positions (FIGS. 10B and 10D) of images formed on the photosensitive body when two images are recorded on one surface of a single recording sheet. FIG. 10E is a view showing the resulting recording sheet after the copying operation. First, when the three slide shutters overlap one another at the position shown in FIG. 10A, a region (hatched portion in FIG. 10B) on the surface of the photosensitive body, which corresponds to the shutter region of the slide shutters at that position, is not discharged. Therefore, an image projected onto this region at a given reduction ratio is obtained as shown in FIG. 10B, and this image is formed on the recording sheet through a copying process involving development, transfer, and fixing. Subsequently, the slide shutters are moved to the position shown in FIG. 10C, and the image shown in FIG. 10D is formed through the same process as described above. This image is transferred to and fixed on the same surface of the recording sheet on which the image shown in FIG. 10B is already formed, thereby obtaining the image shown in FIG. 10E.

Figure 11A:
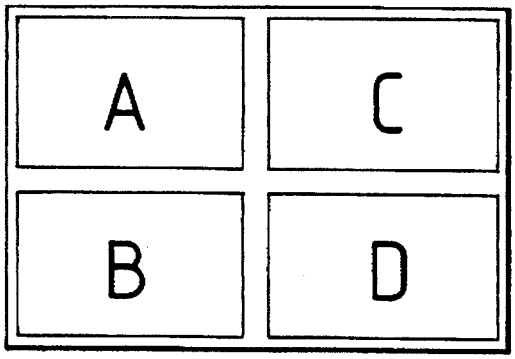
FIGS. 11A to 11E are views for explaining the layouts of images formed on recording sheet.
Figure 11B:
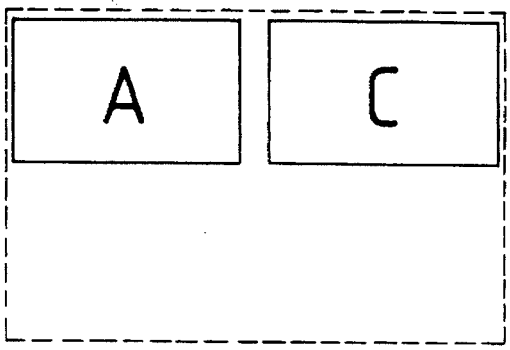
Figure 11C:
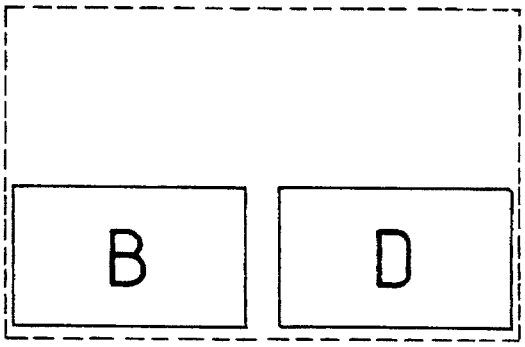
Figure 11D:
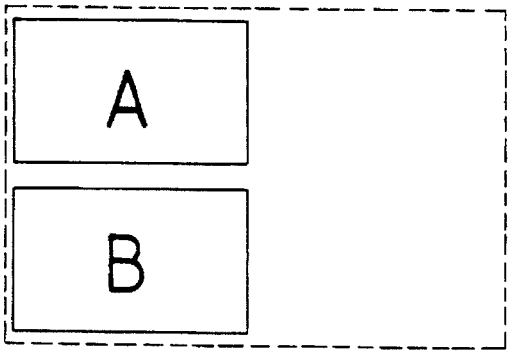
Figure 11E:
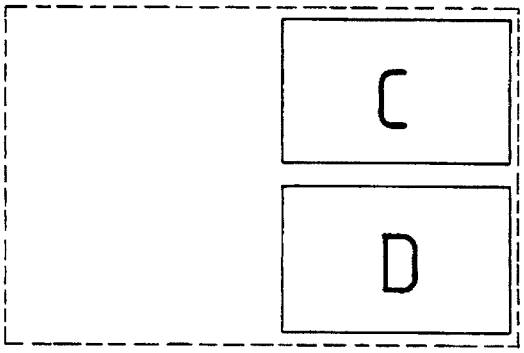

It is also possible to form an image as shown in FIG. 11A by applying the above image forming method. In this case, the copying process including development, transfer, and fixing may be performed each time a single image is formed, or images in each of which two originals are arranged, as shown in FIGS. 11B and 11C, may be formed into the image shown in FIG. 11A by the above image forming method. Alternatively, the image shown in FIG. 11A can be formed by projecting images in each of which two originals are arranged, as shown in FIGS. 11D and 11E, while shifting the positions of the images in the direction of paper feed.

FIG. 12 is a view showing slide shutters according to another embodiment of the present invention.

In the above embodiment, as shown in FIG. 5, the end portions of the first slide shutter (front) 22*a* and the second slide shutter (back) 22*c* have a step with a size d between them. Therefore, even if the slide shutters are arranged symmetrically, the positions of the end portions of the width blank exposure light radiated on the photosensitive drum 11 are not symmetrical, so the position control for the shutters must be performed by taking this fact into account. In the arrangement shown in FIG. 12, however, an end face 62 of a slide shutter (front) 61*a* is arranged at the same level as an end face 63 of a slide shutter (back) 61*c*. As a result, the positions of the end portions of the width blank exposure light radiated on the photosensitive drum 11 become symmetrical, and this simplifies the shutter position control.

The image forming apparatus of the present invention need only employ a plurality of slide shutters. If, however, the number of slide shutters is two, the width of the two shutters is larger than one-half the width of an image even when they overlap each other completely (this is so because even if the full width of an image is to be covered with the two shutters, an overlap portion must be provided between the two shutters in order to prevent an exposure light leakage, and consequently the length of each shutter becomes larger than the half width of an image). To meet the half width of an image, therefore, the two shutters must be moved together while overlapping each other. For this reason, the use of three shutters as in the above embodiments is preferable in terms of the function and the simplification of the apparatus.

It is, of course, possible to arrange a plurality of shutters between two shutters to be driven independently of each other.

Although the preferred embodiments of the present invention have been described above, the present invention is not limited to the above embodiments but can be modified without departing from the spirit and the scope of the invention.

What is claimed is:

1. An image forming apparatus comprising:

a photosensitive body capable of moving;

charging means for charging said photosensitive body;

preexposing means for exposing said photosensitive body at a position upstream of said charging means in a moving direction of said photosensitive body; and first and second blank exposing means for exposing non-image portions of said photosensitive body at a position downstream of said charging means in the moving direction of said photosensitive body, wherein said first blank exposing means exposes non-image portions formed at end portions of an image portion in the moving direction of said photosensitive body, said second blank exposing means exposes non-image portions formed at end portions of the image portion in a direction perpendicular to the moving direction of said photosensitive body, said preexposing means and said first and second blank exposing means share a single common light source, said second blank exposing means has light-shielding means movable in the direction perpendicular to the moving direction of said photosensitive body in order to change an exposure width, and said first blank exposing means has a reflecting member for reflecting light from said light source toward said photosensitive body, said reflecting member having a quadric-surface section.

2. An apparatus according to claim 1, wherein said light-shielding means moves in accordance with a size of an image to be formed on said photosensitive body.

3. An apparatus according to claim 1, wherein said light-shielding means have a plurality of light-shielding members.

4. An apparatus according to claim 3, wherein said plurality of light-shielding members are shifted in position in a direction of an optical axis so as to overlap one another.

5. An apparatus according to claim 4, wherein end portions of said plurality of light-shielding members on the side of each non-image portion are located at substantially the same position in the direction of an optical axis.

6. An apparatus according to claim 1, wherein said first blank exposing means has a shutter for selectively shielding off an exposure optical path.

7. An apparatus according to claim 1, wherein said first blank exposing means has a filter for transmitting light, said filter being substantially perpendicular to an optical axis.

8. An apparatus according to claim 1, wherein said second blank exposing means has a filter for transmitting light, said filter being substantially perpendicular to an optical axis.

9. An apparatus according to claim 1, wherein said second blank exposing means has a plurality of slits in an optical path, an opening width of each of said slits widening toward said photosensitive body.

10. An image forming apparatus comprising:

a photosensitive body capable of moving;

charging means for charging said photosensitive body;

preexposing means for exposing said photosensitive body at a position upstream of said charging means in a moving direction of said photosensitive body; and first and second blank exposing means for exposing non-image portions of said photosensitive body at a position downstream of said charging means in the moving direction of said photosensitive body, wherein said first blank exposing means exposes non-image portions formed at end portions of an image portion in the moving direction of said photosensitive body, said second blank exposing means exposes non-image portions formed at end portions of the image portion in a direction perpendicular to the moving direction of said photosensitive body, said preexposing means and said first and second blank exposing means share a single common light source, said second blank exposing means has light-shielding means movable in the direction perpendicular to the moving direction of said photosensitive body in order to change an exposure width, and said second blank exposing means has a reflecting member for reflecting light from said light source toward said photosensitive body, said reflecting member having a quadric-surface section.

11. An apparatus according to claim 10, wherein said light-shielding means moves in accordance with a size of an image to be formed on said photosensitive body.

12. An apparatus according to claim 10, wherein said light-shielding means have a plurality of light-shielding members.

13. An apparatus according to claim 12, wherein said plurality of light-shielding members are shifted in position in a direction of an optical axis so as to overlap one another.

14. An apparatus according to claim 13, wherein end portions of said plurality of light-shielding members on the side of each non-image portion are located at substantially the same position in the direction of an optical axis.

15. An apparatus according to claim 10, wherein said first blank exposing means has a shutter for selectively shielding off an exposure optical path.

16. An apparatus according to claim 10, wherein said first blank exposing means has a filter for transmitting light, said filter being substantially perpendicular to an optical axis.

17. An apparatus according to claim 10, wherein said second blank exposing means has a filter for transmitting light, said filter being substantially perpendicular to an optical axis.

18. An apparatus according to claim 10, wherein said second blank exposing means has a plurality of slits in an optical path, an opening width of each of said slits widening toward said photosensitive body.

19. An image forming apparatus comprising:

a rotatable photosensitive body;

image forming means for forming an image on said photosensitive body;

blank exposing means for exposing non-image portions except an image portion formed on said photosensitive body by said image forming means, said blank exposing means exposing non-image portions formed at end portions of an image portion in a direction perpendicular to a moving direction of said photosensitive body, and having first and second light-shielding members movable in the direction perpendicular to the moving direction of said photosensitive body in order to change an exposure width;

first driving means for moving said first light-shielding member; and second driving means for moving said second light-shielding member, said first and second driving means being independent of each other, wherein said first light-shielding member and said second light-shielding member are capable of overlapping one another at side ends thereof in the direction perpendicular to the moving direction of said photosensitive body.

20. An apparatus according to claim 19, further comprising two detecting means for detecting reference positions of said first and second light-shielding members, respectively.

21. An apparatus according to claim 19, wherein each of said first and second driving means has a drive motor, a wire, and pulleys.

22. An apparatus according to claim 19, further comprising a third light-shielding member between said first and second light-shielding members.

23. An apparatus according to claim 22, wherein one end of said third light-shielding member engages with said first light-shielding member, and the other end of said third light-shielding member engages with said second light-shielding member.

24. An apparatus according to claim 19, further comprising a plurality of light-shielding members between said first and second light-shielding members.

25. An image forming apparatus comprising:

a rotatable photosensitive body capable of moving;

image forming means for forming an image on said photosensitive body; and blank exposing means for exposing non-image portions except an image portion formed on said photosensitive body by said image forming means, said blank exposing means exposing non-image portions formed at end portions of an image portion in a direction perpendicular to a moving direction of said photosensitive body, and having three light-shielding members, each of said light-shielding members being movable in a direction perpendicular to the moving direction of said photosensitive body in order to change an exposure width.

26. An apparatus according to claim 25, wherein said three light-shielding members are movable to predetermined positions in the direction perpendicular to the moving direction of said photosensitive body.

27. An apparatus according to claim 25, wherein a maximum length of said three light-shielding members when said three light-shielding members are arranged in the direction perpendicular to the rotating direction of said photosensitive body is larger than a width of a recording sheet with a maximum size usable in said apparatus.

28. An apparatus according to claim 25, wherein said three light-shielding members can overlap one another, and a minimum length of said three light-shielding members when said three light-shielding members overlap one another is smaller than a width of a recording sheet with a minimum size usable in said apparatus.

* * * * *

UNITED STATES PATENT AND TRADEMARK OFFICE

CERTIFICATE OF CORRECTION

PATENT NO. : 5,459,557

DATED : October 17, 1995

INVENTOR(S) : Hasegawa, et. al.

It is certified that error appears in the above-indentified patent and that said Letters Patent is hereby corrected as shown below:

Title page,

At [56] U.S. PATENT DOCUMENTS

"4,553,232 8/1985 Fujimura et al." should read --4,533,232 8/1985 Fujimura et al.--.

Column 10,

Line 2, "have" should read --has--.

Signed and Sealed this

Twelfth Day of March, 1996

Bruce Lehman

*Attest:*

BRUCE LEHMAN

*Attesting Officer*

*Commissioner of Patents and Trademarks*